US005777652A

United States Patent [19]

Takeuchi

[11] Patent Number: 5,777,652

[45] Date of Patent: Jul. 7, 1998

[54] THERMAL TRANSFER PRINTER

[75] Inventor: Minoru Takeuchi, Tamayama-mura, Japan

[73] Assignee: Alps Electric Co., Ltd., Japan

[21] Appl. No.: 431,247

[22] Filed: Apr. 28, 1995

[30] Foreign Application Priority Data

| | | | |
|---|---|---|---|
| May 13, 1994 | [JP] | Japan | 6-099833 |
| Aug. 31, 1994 | [JP] | Japan | 6-207202 |
| Sep. 1, 1994 | [JP] | Japan | 6-208765 |
| Sep. 2, 1994 | [JP] | Japan | 6-210123 |
| Sep. 2, 1994 | [JP] | Japan | 6-210124 |
| Sep. 2, 1994 | [JP] | Japan | 6-210125 |

[51] Int. Cl.[6] ..... B41J 2/325; B41J 35/22

[52] U.S. Cl. ..... 347/171; 347/172; 347/174; 347/176; 400/206; 400/206.2

[58] Field of Search ..... 347/171, 172, 347/174, 176; 400/120.01, 120.02, 120.04, 206, 206.2

[56] References Cited

U.S. PATENT DOCUMENTS 5,538,351 7/1996 Miyano ..... 400/206

FOREIGN PATENT DOCUMENTS 60-253578 12/1985 Japan .
2-103174 4/1990 Japan .

*Primary Examiner*—Huan H. Tran
*Attorney, Agent, or Firm*—Brinks Hofer Gilson & Lione

[57] ABSTRACT

A thermal transfer printer wherein a desired ribbon cassette is identified and selected from among plural ribbon cassettes held by a cassette holding portion and is loaded automatically onto a cassette carrier disposed on a carriage. The carriage is provided with a photosensor for detecting an identification mark provided on each ribbon cassette and a control section which judges whether there is any ribbon cassette held by the holding portion and of which type the ribbon cassette is, in accordance with a signal provided from the photosensor as the carriage moves. The carriage is further provided with a mechanism for making control so as to prevent loosening of ink ribbon at the time of ribbon cassette replacement.

4 Claims, 8 Drawing Sheets

THERMAL TRANSFER PRINTER

BACKGROUND OF THE INVENTION

1. Field of the Invention

The present invention relates to a thermal transfer printer and more particularly to a thermal transfer printer capable of selecting a desired ribbon cassette from among plural ribbon cassettes held in a predetermined position and loading the thus-selected ribbon cassette onto a carriage automatically.

2. Description of the Related Art

According to a thermal transfer printer which is popular as an output device of a computer, a word processor, or the like, by reason of high print quality, low noise, low cost and easy maintenance, a recording medium such as paper and an ink ribbon coated with a desired ink are supported in front of a platen, the ink ribbon is drawn out while a thermal head with plural heating elements arranged thereon is reciprocated along the platen together with a carriage, and the heating elements on the thermal head are caused to generate heat selectively in accordance with printing information to print desired images, e.g. letters, onto the recording medium such as paper.

Recently, there has been an increasing demand for color recording in printers, and this demand is no exception in thermal transfer printers. The ink ribbon used in an ordinary thermal transfer color printer is longitudinally provided with ink portions of three colors which are yellow, cyan and magenta or of four colors which are the colors just mentioned plus black, the color ink portions being formed repeatedly so as to be slightly longer than the printing width. Each color ink portion is selected in accordance with recording data and recording is made onto paper using the ink portions thus selected.

However, in a thermal transfer printer using a ribbon cassette containing such repetitive type ink ribbon, a color portion not used for recording of the ink ribbon is skipped over and the next color is selected for recording. Moreover, even if there is an unrecorded blank portion in one row, the ink ribbon is conveyed continuously, so such ink ribbon portion becomes wasteful, resulting in increase of the running cost or increase in the number of ribbon cassettes used. Consequently, there arises an environmental problem that the scraps of used cassettes increase.

For solving such problems there has been proposed a thermal transfer printer which performs color recording while making replacement of ribbon cassettes (see, for example, Japanese Patent Laid-open Nos. 253578/85 and 103174/90).

In this type of a thermal transfer printer, ribbon cassettes each containing an ink ribbon of a single color are held in plural ribbon cassette holding portions respectively, then a ribbon cassette containing an ink ribbon of a color to be used for recording is selected, then a cassette carrier provided reciprocatably on a carriage is moved toward the corresponding ribbon cassette holding portion to receive the selected ribbon cassette, and thereafter the cassette carrier moves away from the ribbon cassette holding portion, allowing the selected ribbon cassette to be loaded onto the carriage.

In such thermal transfer printer there are used various sensors, including a sensor for detecting the kind of color, etc. of each ribbon cassette and a sensor for detecting the home position of the carriage.

The conventional method for detecting the kind of each ribbon cassette has been carried out by making the ribbon cassette shape different or by forming a detection hole corresponding to the kind of ink ribbon in each ribbon cassette and contacting a mechanical switch provided on the carriage side with such detection hole. As to the detection of the carriage home position, it has heretofore been conducted by bringing a position detecting member of the carriage into contact with, for example, a mechanical switch as a home position sensor.

In such thermal transfer printer which performs color recording while making replacement of ribbon cassettes, since each ink ribbon is fed only at its portion to be used for recording, almost the whole area of the ink ribbon is used for recording, with the result that, in comparison with the foregoing repetitive type of ink ribbon, there are attained such excellent effects as decrease of the running cost and decrease in the number of ribbon cassettes which are discarded.

However, for detecting the kind of each ribbon cassette in the above conventional thermal transfer printer, it is necessary to form a special ribbon cassette for each kind of ink ribbon, and the formation of various ribbon cassettes requires various molds, which is disadvantageous from the economic point of view. Besides, much labor and time are required for the storage and inventory management of ribbon cassettes before receiving ink ribbons therein. Further, with such increase in the type of ink ribbons, the structure of the sensor for detecting the type of each ribbon cassette becomes complicated and expensive, leading to increase in the total cost of the thermal transfer printer, thus making it impossible to meet the recent demand for cost reduction.

Moreover, in the foregoing thermal transfer printer which replaces ribbon cassettes for color recording, the ink ribbon contained in each ribbon cassette sometimes becomes loose due to vibrations caused by movement of the cassette carrier at the time of cassette replacement. If the ribbon cassette is loaded onto the carriage in a loosened state of the ink ribbon, the ink ribbon portion exposed from the ribbon cassette may strike against the thermal head and make smooth loading of the ribbon cassette difficult, or the ink ribbon may be wrinkled, which leads to deterioration of the recording quality.

After receipt of the ribbon cassette, the cassette carrier goes down. At this time, if engaging portions of ribbon cassette feed reel and take-up reel are not in exact correspondence to engaging portions of feed bobbin and take-up bobbin, both engaging portions come into collision with each other, so that the loading of the ribbon cassette onto the carriage is sometimes not effected to a satisfactory extent.

SUMMARY OF THE INVENTION

The present invention has been accomplished for solving the above-mentioned problems and it is the object of the invention to provide a thermal transfer printer of a simple structure capable of discriminating a wide variety of ribbon cassettes automatically, capable of attaining the reduction of cost and further capable of surely detecting whether a ribbon cassette is present or not on the carriage.

It is another object of the present invention to provide a thermal transfer printer capable of preventing loosening of an ink ribbon at the time of ribbon cassette replacement.

It is a further object of the present invention to provide a thermal transfer printer capable of effecting the loading of a ribbon cassette onto the carriage in a satisfactory manners at the time of ribbon cassette replacement.

It is a still further object of the present invention to provide a thermal transfer printer capable of surely absorbing a shock upon collision of a cassette carrier with a ribbon cassette and hence capable of performing the ribbon cassette replacement in a stable manner.

DETAILED DESCRIPTION OF THE PREFERRED EMBODIMENTS

Figure 1:
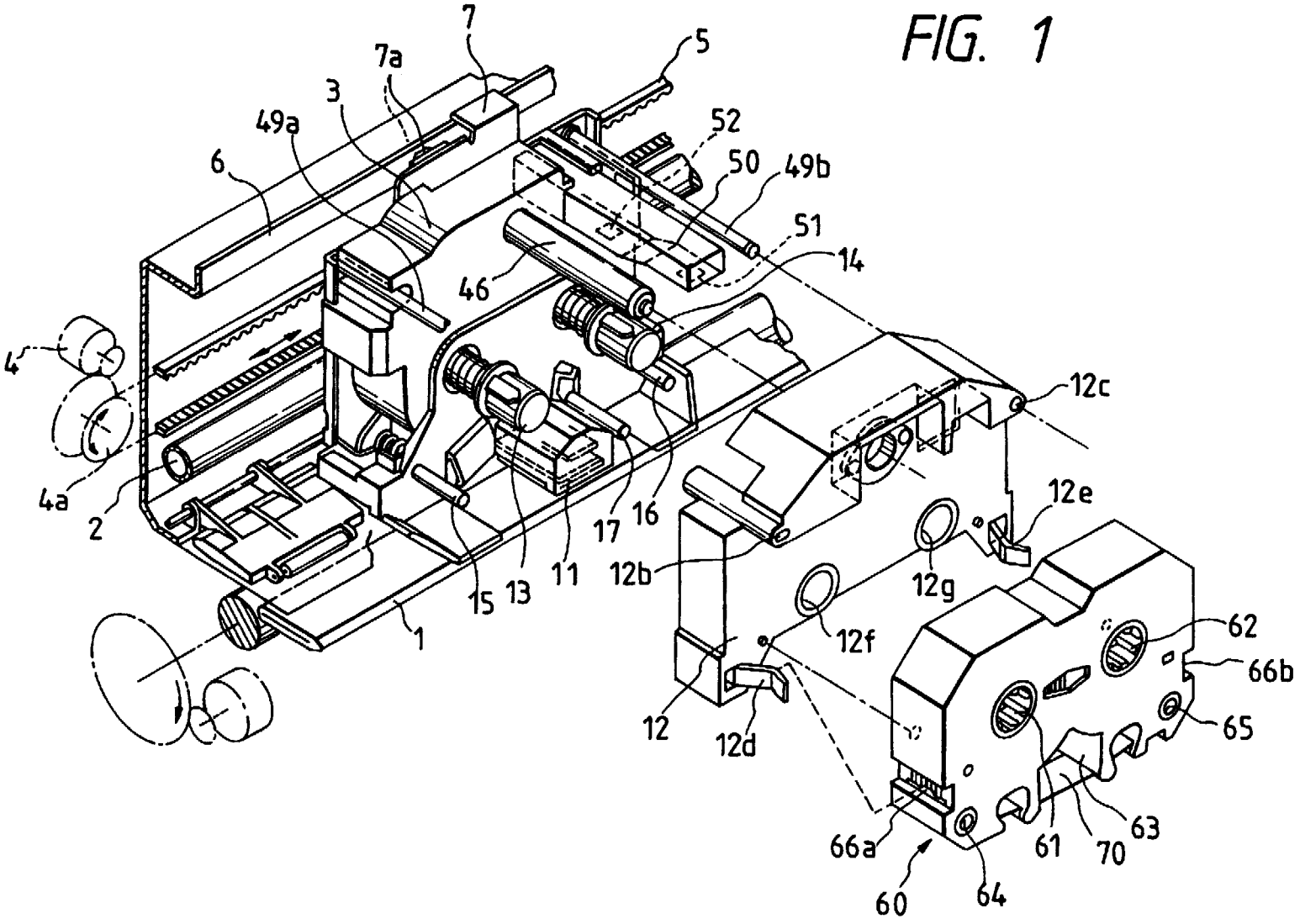
FIG. 1 is a construction diagram of principal portions of a thermal transfer printer according to an embodiment of the present invention.

The thermal transfer printer embodying the present invention will be described below with reference to the accompanying drawings. As shown in detail in FIG. 1, the thermal transfer printer of this embodiment has a flat plate-like platen 1 which undergoes a load at the time when paper and an ink ribbon 70 are pressed by a thermal head 11 as will be described later. A carriage guide shaft 2 extending in parallel with the platen 1 is mounted bridgewise on both right and left side places (not shown) of a body case of the thermal transfer printer, and a carriage 3 serving as a principal portion for recording is held slidably by the guide shaft 2. Further, the body case of the printer is formed with a plate-like carriage guide portion 6 in parallel with the platen 1 which guide portion 6 saves to guide the movement of the carriage 3. On the other hand, a carriage support portion 7 is provided projectingly at the rear portion of the carriage 3 and it is held slidably by the carriage guide portion 6.

A carriage driving motor 4 is disposed in a lower position behind the carriage guide portion 6, and near the motor 4 is disposed a sprocket 4*a* which is rotated by the motor 4. On the sprocket 4*a* is entrained a toothed drive belt 5 which is fixed at end portions to the carriage 3. Upon operation of the carriage driving motor 4, the toothed drive belt 5 moves and through this movement the carriage 3 is reciprocated along both guide shaft 2 and carriage guide portion 6 and in parallel with the platen 1. The carriage support portion 7 which guides the carriage 3 so as to slide along the carriage guide portion 6 is generally ]-shaped in its section, and on both inside opposed faces of the ]-shape are formed projections 7*a* for abutment with the carriage guide portion 6 to prevent wobbling during movement of the carriage 3.

On the carriage 3 are mounted a thermal head 11 having a plurality of heating elements (not shown) arranged movably for contact with and separation from the platen; a cassette carrier 12 capable of reciprocating in the direction perpendicular to the moving direction of the carriage 3 during recording and capable of carrying a ribbon cassette 60 thereon; a feed bobbin 13 and a take-up bobbin 14 which are engaged with a feed reel 61 and a take-up reel 62, respectively, with ink ribbon 70 being wound round both reels so that the windings start with both ends of the ink ribbon; a second feed bobbin 15 and a second take-up bobbin 16 which are engaged with a pair of pinch rollers 64 and 65, respectively, disposed in up- and downstream positions in the traveling direction of the ink ribbon 70 on both sides of a thermal head inserting portion 63 of the ribbon cassette 60 which portion 63 is formed in a concave shape and into which an intermediate part of the ink ribbon 70 drawn out from the ribbon cassette 60 to the exterior faces in a front position; a release roller 17 disposed on the downstream side of the thermal head 11 in the traveling direction of the ink ribbon 70, the release roller 17 being driven selectively according to the kind of the ribbon cassette 60 used; and drive members for driving the above members as will be described later. The feed bobbin 13 and the take-up bobbin 14 are constructed reciprocatably with movement of the cassette carrier 12 so as to face at least partially onto the cassette carrier 12.

Figure 2:
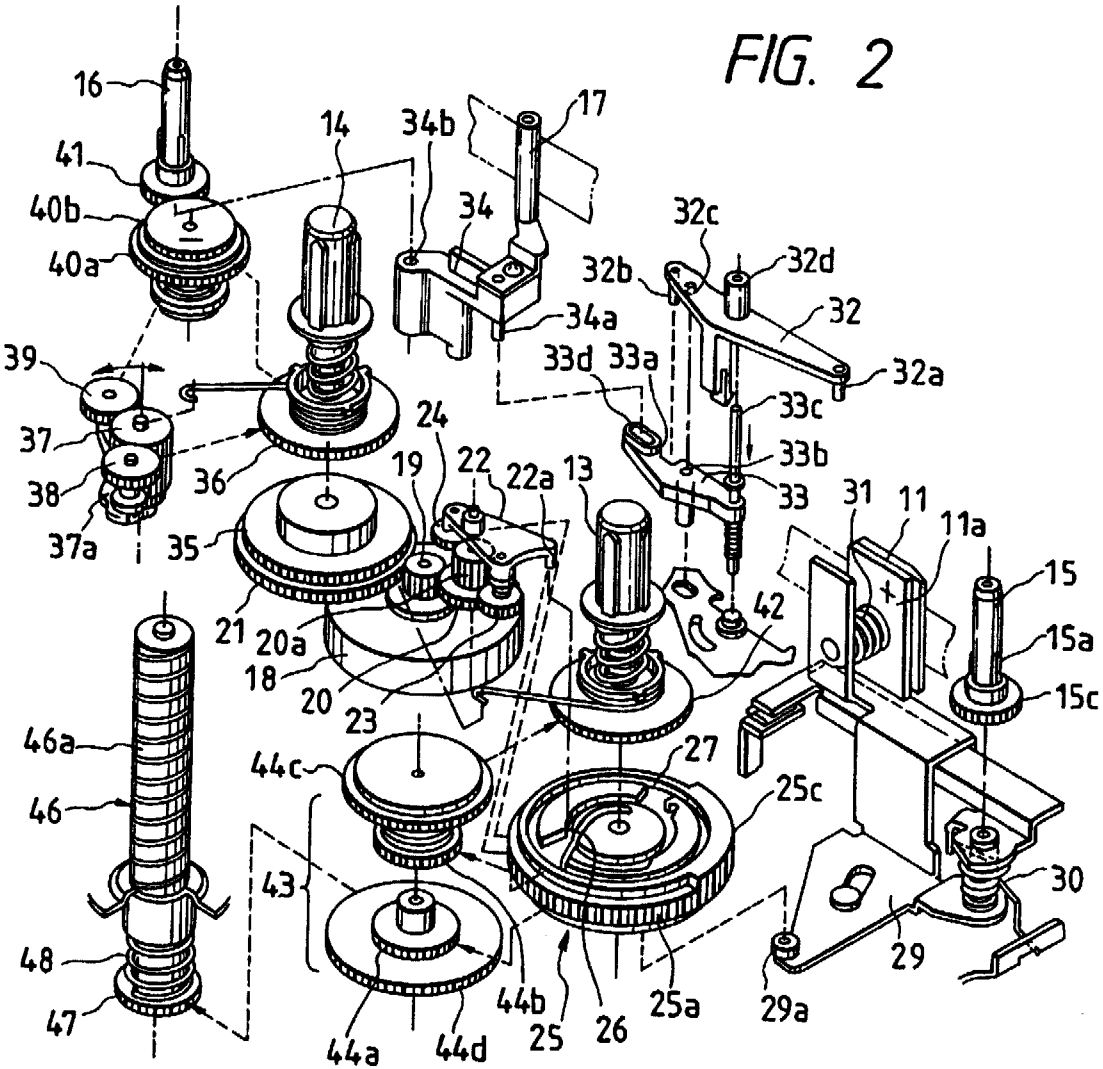
FIG. 2 is an exploded perspective view showing how principal portions of the thermal transfer printer are constructed.

As will be described later, all of the pressure-contacting and decontacting motions of the thermal head 11 with respect to the platen 1, the moving motions of the cassette carrier 12 in the contacting and leaving direction with respect to the carriage 3, the ink ribbon feeding, winding and back-winding operations, and the operation of the release roller 17, are performed using a single stepping motor 18 (FIG. 2) as a drive source. Thus, since only one stepping motor 18 is used as a drive source, it is possible to attain the reduction of cost because the components used are extremely inexpensive in comparison with the motor although the mechanism is complicated. Further, it is also possible to easily fabricate a drive circuit for the stepping motor 18.

The pressure-contacting motion of the thermal head 11 with respect to the platen 1 is here designated head-down motion and the leaving motion thereof from the platen 1 designated head-up motion.

A first transfer gear 20 and a second transfer gear 21 are in mesh with an output pinion gear 19 of the stepping motor 18. On the upper surface of the first transfer gear 20 is mounted a generally triangular swing plate 22 which is pivotable about a rotational center 20*a* of the transfer gear 20.

At one end portion of the swing plate 22 is disposed a pin 22*a* which comes into engagement with a cam groove 26 formed in the upper surface of a cam 25, while at two other end portions are disposed a first swing gear 23 and a second swing gear 24 in mesh with the transfer gear 20. According to the position of the swing plate 22, one of the swing gears 23 and 24 is brought into mesh with a gear portion 25*a* of the cam disposed near the swing plate 22, the gear portion 25*a* being formed nearly centrally in the width direction of the outer peripheral surface of the cam 25 and having a toothless part 25*b*. Engaged with the upper surface of the swing plate 22 is the front end of a spring (not shown), and by the biasing force of this spring the swing plate 22 is kept urged toward the cam 25.

Figure 6:
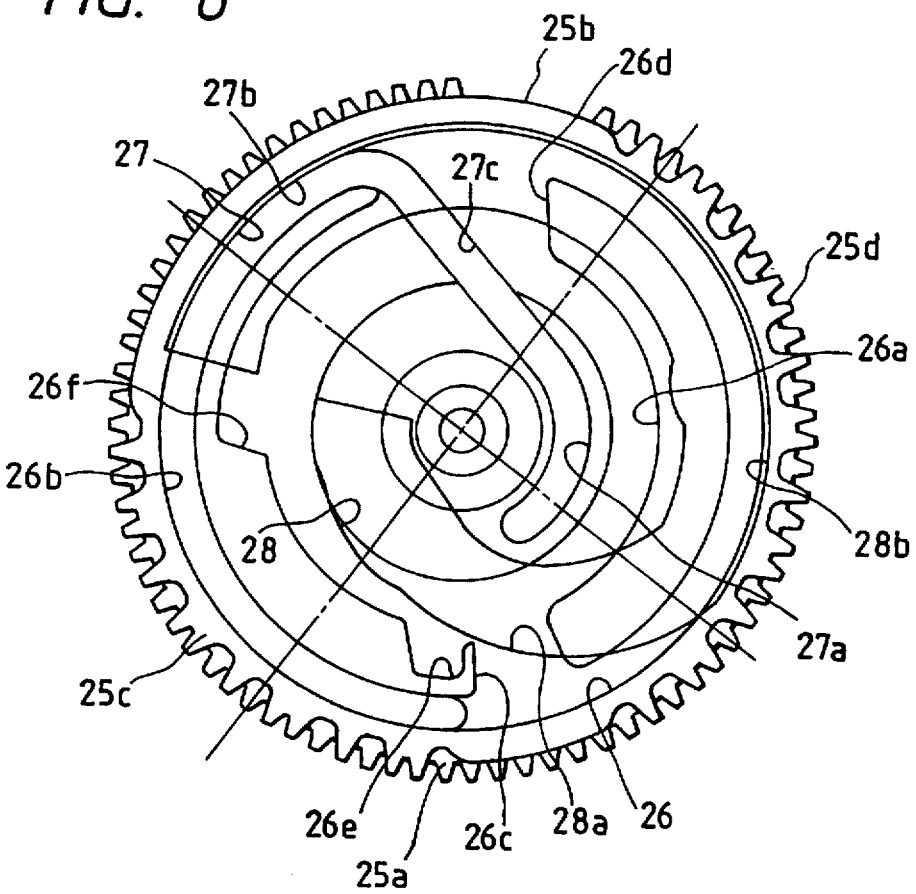
FIG. 6 is an explanatory view showing the construction of a cam used in the thermal transfer printer.

On the outer periphery of the cam 25 are formed, as shown in FIG. 6, the gear portion 25*a* being formed nearly centrally in the thickness direction and throughout the whole circumference and having the toothless part 25*b* formed partially in the circumferential direction; a first intermittent gear 25*c* formed in the upper portion in the thickness direction and in the range of about one-fourth of the circumference; and a second intermittent gear 25*d* formed in the lower portion in the thickness direction and in the range of about two-fifth of the circumference in a positionally deviated relation to the first intermittent gear 25*c* in the circumferential direction. Both intermittent gears 25*c* and 25*d* have such a tooth shape as shown in FIG. 6 in which two adjacent teeth and one tooth are arranged successively in an alternate manner at intervals each corresponding to one tooth.

In the upper surface of the cam 25 are formed a first cam groove 26 for engagement with the pin 22*a* of the swing plate 22 and a second cam groove 27 for contact and decontact of the release roller, while in the lower surface of the cam 25 is formed a cam groove 28 for contact and decontact of the thermal head.

The first cam groove 26 is constructed in such a manner that annular, concentric, inner groove 26*a* and outer groove 26*b* are in communication with each other through two communication grooves 26*c* and 26*d* which are positioned approximately in the diametrical direction. As shown in FIG. 1, when the first swing gear 23 meshes with the gear portion 25*a*, the pin 22*a* is brought into engagement with the inner groove 26*a*, while when the second swing gear 24 meshes with the gear portion 25*a*, the pin 22*a* is brought into engagement with the outer groove 26*b*. Further, the first cam groove 26 is provided in its inner groove 26*a* with retaining portions 26*e* and 27*f* for the pin 22*a* to hold both swing gears 23 and 24 in positions not meshing with the gear portion 25*a*.

The second cam groove 27 for contact and decontact of the release roller is constructed in such a manner that an arcuate groove 27 formed centrally of the cam 25 and an arcuate groove 27*b* formed in the range of about 160° in the outer peripheral portion of the cam 25 are in communication with each other through a rectilinear communication groove 27*c*.

Further, the cam groove 28 for contact and decontact of the thermal head comprises a curved groove 28*a* extending from the central part of the cam 25 to the outer peripheral portion thereof and an arcuate groove 28*b* formed in the range of about 190° and contiguous to the outer end of the curved groove 28*a*.

Near the cam 25 is disposed a head pressing lever 29 of a bent shape in such a manner that a lower side portion of the lever is supported pivotably about a shaft 30. A pin 29*a* is provided projectingly at one end portion of the head pressing lever 29 and it is engaged with the head contacting/decontacting cam groove 28 of the cam 25. The other end portion of the head pressing lever 29 is adapted to press through a compression spring 31 the back of a head mount 11*a* with the thermal head 11 attached thereto.

Near the cam 25 is also disposed a generally <-shaped, release roller driving lever 32, and a pin 32*a*, and at one end portion of the lever 32 is formed a pin 32*a* for engagement with the release roller contacting/decontacting cam groove 27 formed in the surface of the cam 25, while at the opposite end portion of the lever 32 are formed both second pin 32*b* capable of engaging a recess 33*a* of a transfer member 33 and third pin 32*c* capable of entering into a hole 33*b* of the transfer member 33 which is interlocked with the release roller driving lever 32. On the upper surface of the lever 32 is formed a cylindrical protrusion 32*d* in a nearly central position.

At one end portion of the transfer member 33 is formed a rod-like pin 33*c*. The lower end portion of the pin 33*c* is fixed to the carriage 3 through a spring 33*d*, while the upper end portion thereof is inserted into the hole 32*c* of the cylindrical protrusion 32*d* so as to project from the upper end of the hole, whereby the lever 32 is held on the transfer member 33. An elongated hole 33*d* is formed in the opposite end portion 33*d* and a pin 34*a* projecting downward from a release roller mounting member 34 is inserted into the elongated hole 33*d*. Further, the end of the mounting member 34 opposite to the pin 34*a* side, which end is indicated at 34*b*, is fitted on a pin (not shown) projecting upward from the carriage so as to be pivotable about the pin. In this construction, the release roller 17 is moved into contact with and away from the platen 1 through the transfer member 33 by the pivotal motion of the release roller driving lever 32, but in the case where the ribbon cassette used pushes the tip end portion of the rod-like pin 33*c* and forces down the pin, the pin 32*c* of the lever 32 is not inserted into the hole 33*b* of the transfer member 33, so that the release roller 17 does not rotate.

The second take-up bobbin 16 is rotatably fitted on and held by the pin on which is fitted the hole 34*b* formed in the opposite end portion of the release roller mounting member 34.

Figure 7:
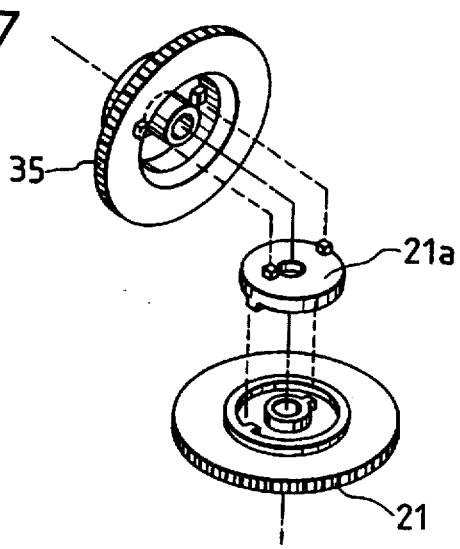
FIG. 7 is an exploded explanatory view showing a connection structure between a second transfer gear and a gear in the thermal transfer printer.

The second drive gear 21 meshing always with the output pinion gear 19 of the stepping motor 18 is disposed on the carriage 3 rotatably about a rotating shaft. As best seen in FIG. 7, a gear 35 adapted to rotate following the rotation of the drive gear 21 is connected onto the upper surface of the second drive gear 21 with a certain play through a connection member 21*a*. On the upper surface of the gear 35 is disposed a take-up gear 36, and above the take-up gear 36 is mounted the take-up bobbin 14 coaxially through a friction mechanism.

Further, transfer gear 37 which is kept in mesh with the gear 35 is disposed on the carriage 3, and to the transfer gear 37 are connected both first swing gear 38 and second swing gear 39 through a swing plate 37*a*, the gears 38 and 39 being kept in mesh with the transfer gear 37. The transfer gear 37 is kept urged toward the take-up gear 36 by means of a gear.

The second take-up bobbin 16 is disposed on the carriage 3 through the release roller mounting member 34, and under the bobbin 16 is mounted a second take-up gear 41 coaxially through a friction mechanism (not shown), the second take-up gear 41 being brought into mesh with the take-up gear 36 of the take-up bobbin 14 through transfer gears 40*a* and 40*b*.

The first and second swing gears 38 and 39 are provided so that the rotating direction of the take-up bobbin 14 and that of the second take-up bobbin 16 become constant independently of the rotating direction of the stepping motor 18. In accordance with the rotating direction of the stepping motor 18 the first swing gear 38 comes into mesh with the take-up gear 36, or the second swing gear 39 comes into mesh with the transfer gear 40*a*.

In this embodiment, when the stepping motor 18 rotates in the counterclockwise direction, the first swing gear 38 comes into mesh with the take-up gear 36, while when the stepping motor 18 rotates in the clockwise direction, the second swing gear 39 meshes with the transfer gear 40*a*, whereby the rotating force is transferred to the take-up bobbin 36 and the second take-up bobbin 41. As mentioned above, moreover, the gear 35 is disposed on the upper surface of the second drive gear 21 with a certain play through the connection member 21, so in the case where the rotating direction of the stepping motor 18 becomes opposite, for example when the cam 25 is rotated for the head-up or -down operation, the rotation of the second transfer gear 21 is not transmitted to the gear 35 and hence the ribbon take-up operation is not performed. Between the take-up bobbin 14 and the take-up gear 36 is disposed a spring clutch to make control so that the bobbin 14 rotates always in only one direction (the winding direction of the ink ribbon 70). As a result, the ink ribbon 70 which has been wound up onto the take-up bobbin 14 is not drawn out in the reverse direction and hence loosening does not occur.

Further, the feed bobbin 13 is disposed on the upper surface of the cam 25, and a feed gear 42 is attached coaxially to the bottom of the feed bobbin 13 through a friction mechanism (not shown), so that a certain feed load (back tension) can be imposed on the ink ribbon 70 or the back-winding operation of the ink ribbon can be performed with replacement of the ribbon cassette 6 as will be described later.

A transfer mechanism 43 serving as a cassette carrier driving means is disposed in the vicinity of the cam 25. The transfer mechanism 43 comprises a gear 44*a* capable of meshing with the second intermittent gear 25*d* formed at the lower outer peripheral portion of the cam 25, a gear 44*b* capable of meshing with the first intermittent gear 25*c*, a transfer gear 44*d* adapted to rotate integrally with the gear 44*a*, and another transfer gear 44*c* which is connected with the gear 44*b* through the foregoing spring clutch mechanism for transfer of only the counterclockwise rotation of the gear 44*b*. When the cam 25 further rotates from its initial head-up position, the gear 44*a* rotates in mesh with the second intermittent gear 25*d* so that the rotating force is transmitted through the gear 44*d* to a lift gear 46 which will be described later.

The gears 44*b* and 44*a* of the transfer mechanism 43 capable of meshing with the first and second intermittent gears 25*c* and 25*d*, respectively, of the cam 25 are of a shape such that two large teeth and one small tooth are formed in an alternate manner. This is for ensuring the transfer of rotation between them and the first, second intermittent gears.

Figure 8:
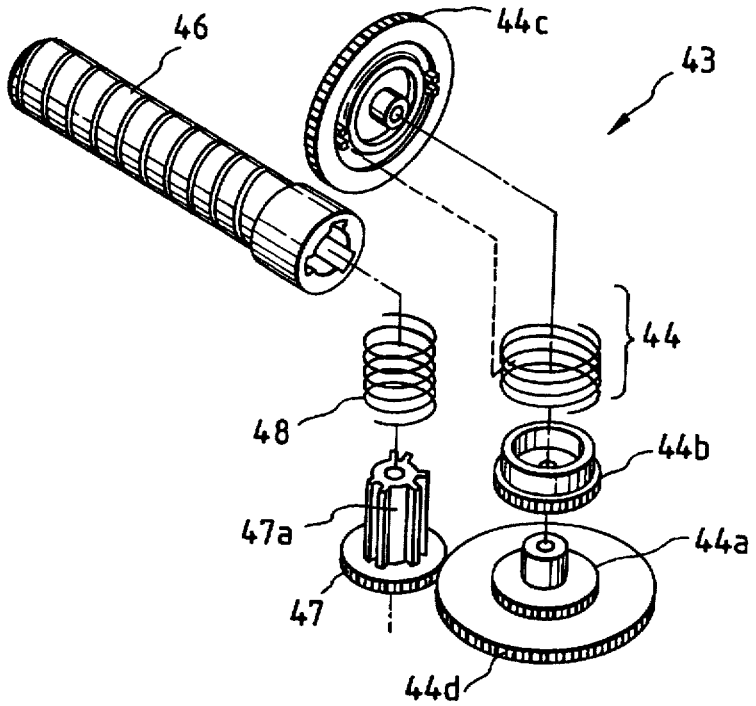
FIG. 8 is an exploded explanatory view showing the structure of a lift gear and that of a transfer member in a cassette carrier driving mechanism used in the thermal transfer printer.
Figure 9:
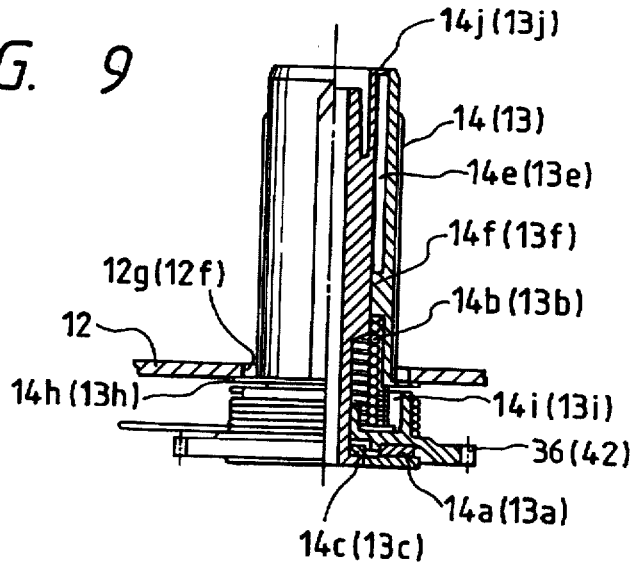
FIG. 9 is a front view, with half being illustrated in vertical section, showing the structure of a ribbon take-up bobbin and that of a ribbon feed bobbin in an approached state of the cassette carrier relative to a carriage in the thermal transfer printer.

Since the upper gear 44*b* and transfer gear 44*c* located on the upper surface of the gear 44*b* are disposed through the spring clutch 44*d* (FIG. 8), they rotate always in only one direction (counterclockwise direction in this embodiment), so that the feed gear 42 meshing with the transfer gear 44*c* can rotate in only the back-winding direction. Consequently, a certain load from the aforementioned friction mechanism works on the feed of the ink ribbon 70 to prevent loosening or the like of the ribbon when drawn out.

In the vicinity of the transfer mechanism 43 is disposed a lift gear 46 having a screw groove 46*a* formed in its outer peripheral portion. The lower end portion of the lift gear 46 is splined to a rotating shaft 47*a* of a gear 47 through a coiled spring 48 which serves as a shock absorbing member for absorbing a shock upon collision of the cassette carrier 12 with the ribbon cassette 60 at the time of reception of the cassette by the carrier, the gear 47 meshing with the gear 44*d* which is in mesh with the intermittent gear 25*b* of the cam 25. In this construction, the lift gear 46 rotates together with the gear 47 and it can slightly move up and down under the action of the coiled spring 48. By this up-and-down movement it is made possible to absorb a shock.

Thus, since various mechanisms are driven and controlled by means of a single cam, the number of components used may be small and the reduction of cost can be attained thereby.

In the cassette carrier 12 there are formed a hole 12*a* having a tooth portion for engagement with the screw groove 46*a* of the lift gear 46 and holes 12*b*, 12*c* for insertion therein of a pair of guide members 49*a* and 49*b* which are disposed on the carriage 3. According to this construction, with rotation of the lift gear 46, the cassette carrier 12 can reciprocate on the carriage 3 along the guide members 49*a* and 49*b* in the direction perpendicular to the moving direction of the carriage 3. On the cassette carrier 12, moreover, a pair of <-shaped holding members 12*d* and 12*e* for engagement with the holding portion of the ribbon cassette 60 to hold the cassette are disposed spacedly from each other in right and left positions, the holding members 12*d* and 12*e* being urged in a narrowing direction of the spacing by means of an urging member (not shown). Further, the cassette carrier 12 is formed with a pair of circular holes 12*f* and 12*g* for loose insertion therein of the feed bobbin 13 and take-up bobbin 14.

On the carriage 3, as shown in detail in FIG. 1, there is mounted a sensor mounting plate 50 provided with both first sensor 51 for detecting the type of the ribbon cassette 60 held in a predetermined position of the body case and second sensor 52 for detecting whether the ribbon cassette 60 is present or not on the carriage 3. As illustrated in the drawing, the first and second sensors 51, 52 employ reflection type optical sensors of different focal lengths, and the sensor mounting plate 50 is formed in such a shape as to permit the first sensor 51 to be disposed in a somewhat spaced position from the ribbon cassette 60 and the second sensor 52 in a closer position to the cassette.

The sensor 51 is connected to a control section which is disposed in a desired position of the thermal transfer printer 1 to control the printing operation, etc. of the printer. This control section comprises memory, CPU, etc. (not shown), and in accordance with output signals provided from photosensors with movement of at least the carriage 3, the control section can discriminate or detect the presence or absence of the ribbon cassette 60, the type of ink ribbon 70 contained in the cassette, the distance of the carriage 3 from its home position, whether a canopy 80 which will be described later is open or closed, the distance between a pair of adjacent or spaced ribbon cassettes 60.

Figure 3:
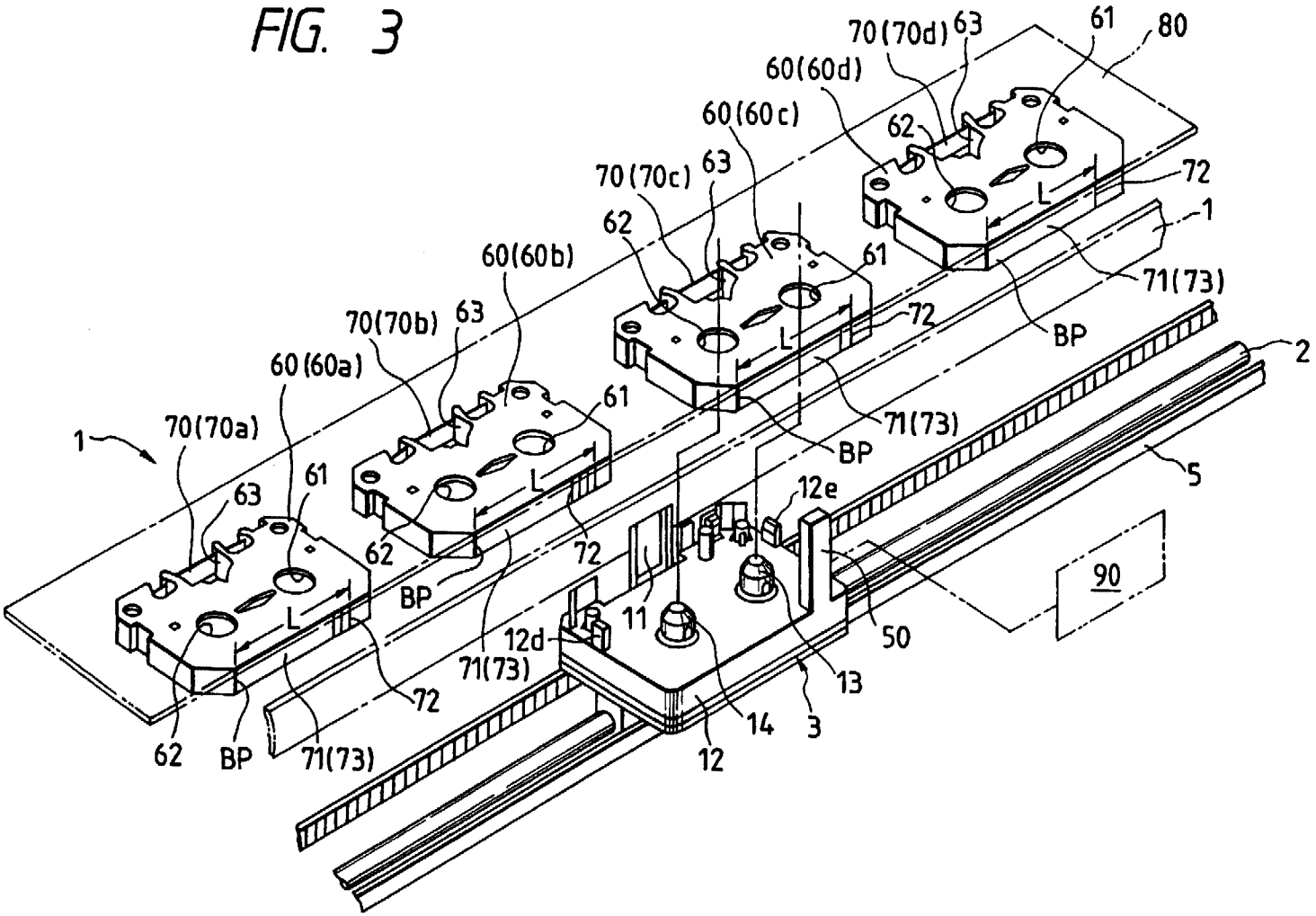
FIG. 3 is a perspective view also showing how principal portions of the thermal transfer printer are constructed.
Figure 4:
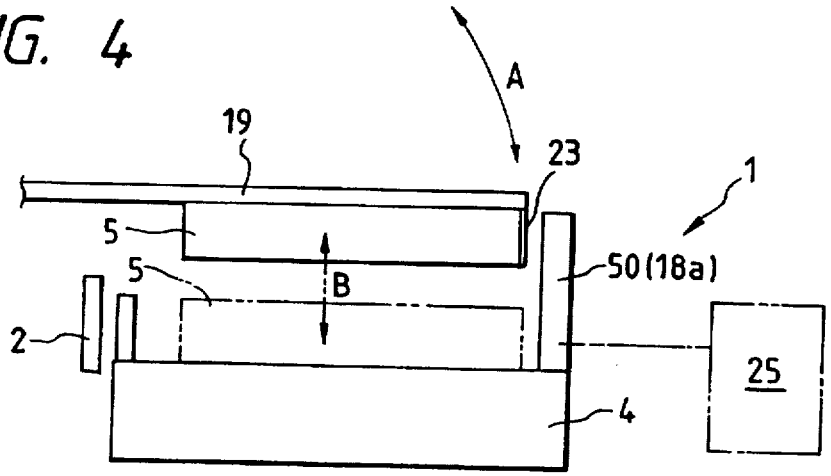
FIG. 4 is a side view showing a schematic construction of a principal portion of the thermal transfer printer.

Above the carriage 3 and through an appropriate spacing from the carriage, as shown in FIGS. 3 and 4, a substantially plate-like canopy 80 is supported by a frame (not shown) in such a manner that it can be opened and closed as indicated with a double arrow A. In the closed state the canopy 80 functions as a paper presser on the outlet side of a paper feed mechanism (not shown) and it has approximately the same length as that of the moving range of the carriage 3 in an opposed relation to the carriage.

The underside of the canopy 80 extending in parallel with the carriage 3 is provided with a plurality of cassette holding portions (not shown) for holding ribbon cassettes 60. By these cassette holding portions, ribbon cassettes 60*a*, 60*b*, 60*c* and 60*d* containing ink ribbons 70*a*, 70*b*, 70*c* and 70*d*, respectively, of four colors for multi-color printing in this embodiment are arranged in a row in the moving direction of the carriage 3. As indicated with a double arrow B in FIG. 4, the ribbon cassettes are taken in and out selectively between the cassette holding portions of the canopy 80 and the cassette carrier 12.

The ribbon cassettes 60*a*, 60*b*, 60*c* and 60*d* used in this embodiment are all formed in the same shape and size irrespective of the type of ink ribbon 70. Within the case body which is generally rectangular in plan there are disposed a pair of reels 61, 62 supported rotatably, a pair of ribbon feed roller also supported rotatably, and a plurality of guide rollers also supported rotatably and facing the ribbon traveling path. Ink ribbon 70 is wound between the paired reels 61 and 62, with an intermediate portion of the ribbon traveling path being exposed to the exterior. Upon loading of the cassette onto the cassette carrier 12, one of the reels 61 and 62 is used as a take-up reel for winding up the portion of the ink ribbon 70 which portion has been used for printing, while the other reel is used as a delivery reel for sending out the ink ribbon. In the inner peripheral surface of each reel 61 (62) are formed a plurality of key ways in a spline shape and spacedly in the circumferential direction. The inner peripheral surface of one reel 62 defines a take-up hole for engagement with the take-up bobbin 14, while that of the other reel 61 defines a delivery hole for engagement with the feed or delivery bobbin 13. On the side of the ribbon cassette 60 which side comes into opposition to the platen 1 in the loaded state on the carriage 3, there is formed a recess 63 in which the thermal head 11 faces, and an intermediate portion of the ink ribbon 70 is exposed to the interior of the recess 63.

On the back side extending in parallel with the recess 63-formed side of the ribbon cassette 60 there is provided an identification mark. The identification mark 71 used in this embodiment is formed by a reflection seal 73 having stripe-like non-reflective portion(s) 72 the number of which differs depending on the type of each ink ribbon 70. The identification mark 71 is detected by a photosensor 51 provided on the carriage 3, the detected signal is fed to a control section 90, and the number of non-reflective portion(s) 72 of each ribbon cassette 60 is counted in the control section 90 to detect the type of ink ribbon 70 contained in each ribbon cassette 60.

More specifically, a reflection seal 73 having three non-reflective portions 72 is provided as an identification mark in the leftmost ribbon cassette 60*a* in FIG. 3, then successively, in the ribbon cassette 60*b* is provided a reflection seal 73 having four non-reflective portions 72*a* as an identification mark 71, a reflection seal 73 having two non-reflective portions 72*a* is provided as an identification mark 71 in the ribbon cassette 60*c*, and a reflection seal 73 having one non-reflective portion 72*a* is provided as an identification mark 71 in the ribbon cassette 60*d*. The leftmost portion of the rear side of each ribbon cassette 60 serves as a reference position BP for the detection of identification mark 71, and the distance L from the reference position BP up to the rightmost end of the non-reflective portion 72 located in the rightmost position in the figure is set equal in all the identification marks. Within the distance L is formed a desired non-reflective portion(s) 72*a* for discriminating the type of ink ribbon 70. When the identification mark 71 used is detected by the photosensor 51, the carriage 3 can be stopped, and in this state the ribbon cassette 60 held by the cassette holding portion is delivered to the cassette carrier 12.

The identification mark 71 may be printed to the ribbon cassette 60, with no limitation being placed on the construction of this embodiment.

At the lower end of the bobbin 14 (13) is formed a flange-like stopper 14*h* (13*h*) circumferentially, which stopper comes into abutment with the outer peripheral edge of the circular hole 12*g* (12*f*) of the cassette carrier 12 to prevent dislodgment of the bobbin 14 (13) from the cassette carrier 12. Moreover, a coiled spring 14*i* (13*i*) for urging the bobbin 14 (13) upward is in abutment with the lower end of the bobbin so that the bobbin can reciprocate in accordance with the movement of the cassette carrier 12 so as to face above the cassette carrier at least partially. Further, in order to prevent the bobbin 14 (13) from coming off the core 14*b* (13*b*), a stopper 14*j* (13*j*) capable of coming into abutment with a key 14*f* (13*f*) of the bobbin is projectingly provided at the front end of the core.

Figure 10:
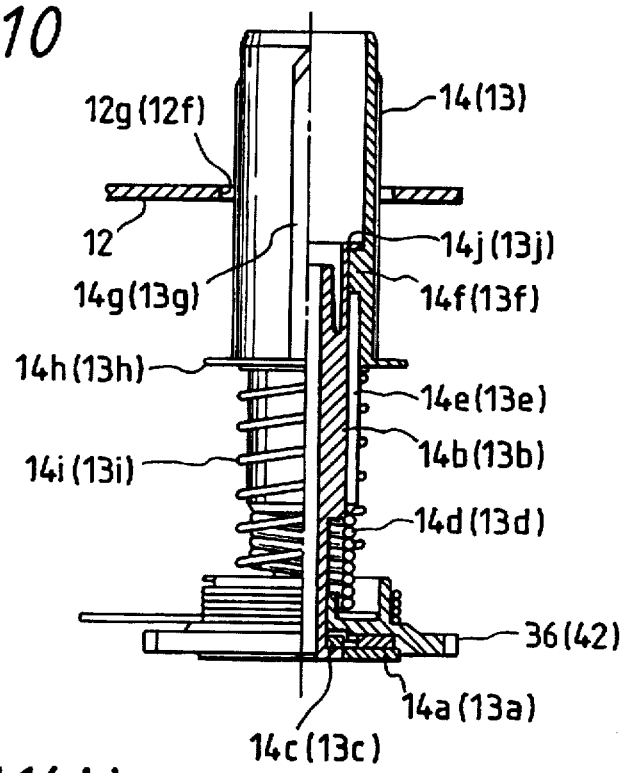
FIG. 10 is a front view, with half being illustrated in vertical section, showing the structure of the ribbon take-up bobbin and that of the ribbon feed bobbin in a removed state of the cassette carrier from the carriage in the thermal transfer printer.
Figure 11A:
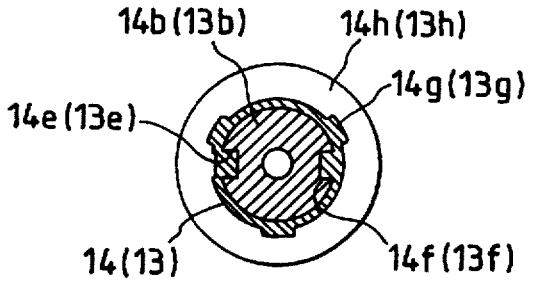
FIGS. 11(A) and 11(B) are diagrams showing a correlative construction between core and bobbin both illustrated in FIG. 10.
Figure 11B:
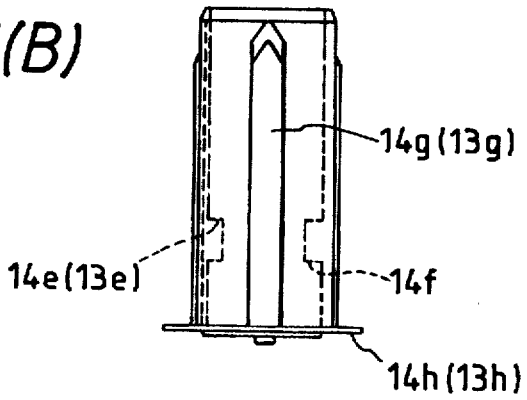
Figure 12:
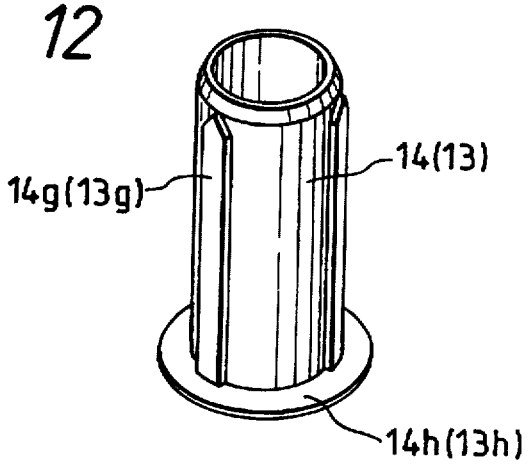
FIG. 12 is a perspective view of the bobbin illustrated in FIG. 11.

In this construction, as shown in FIG. 10, even if the cassette carrier 12 is spaced to the maximum extent from the carriage 3, the bobbin 14 (13) is kept engaged with the associated reel in the ribbon cassette, with no fear of loosening of the ink ribbon 70 in the ribbon cassette 60 even under vibrations during movement of the cassette carrier. In this state, by rotation of the feed bobbin 13 and take-up bobbin 14, it is possible to remove looseness of the ink ribbon 70 if such looseness should occur for some reason or other while the ribbon cassette is held by the ribbon cassette holding portion.

Figure 13:
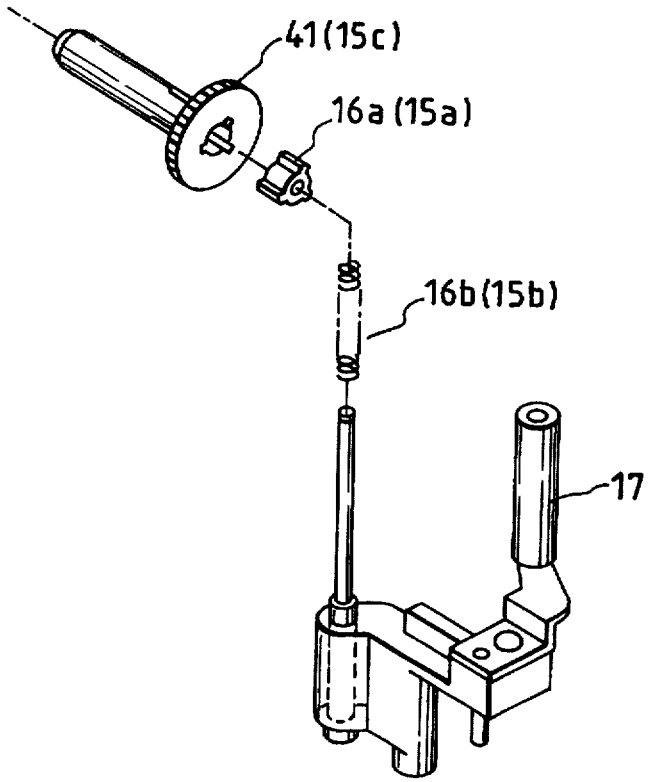
FIG. 13 is an exploded explanatory view showing the structure of a second ribbon take-up bobbin and a delivery bobbin in the thermal transfer printer.

As shown in FIG. 13, engaging members 16*a* and 15*a* for engagement with the engaging portions of the reels of each ribbon cassette 60 are formed in the second take-up bobbin 16 and second feed bobbin 15, respectively, so as to be movable up and down through upwarding biasing springs 16*b* and 15*b*, respectively. Further, restriction members (stoppers) 16*c* and 15*c* for restricting the upward movement of the thus spring-biased engaging portions 16*a* and 15*a* are formed at the tops of the bobbins 16 and 15, respectively.

The operation of this embodiment constructed above will be described below.

Reference will first be made to an example of detecting operation for the ribbon cassette 60 by the thermal transfer printer of this embodiment.

The ribbon cassette detecting operation is performed in the following manner by the thermal transfer printer of this embodiment. As the carriage located in its home position is driven and moved (traveled) rightward in FIG. 3 in accordance with a command provided from the control section 90, the photosensor 51 disposed on the carriage 3 detects the identification mark 71 of the ribbon cassette 60. The photosensor 51 then sends a detected signal peculiar to each identification mark 71 and based on the arrangement and pitch of the non-reflective portions to the control section 90, which in turn judges whether the identification mark 71 corresponds to the command or not. If the answer is affirmative, the control section 90 stops the movement of the carriage 3, while if the answer is negative, the carriage is allowed to move until detection of an identification mark 71 corresponding to the command.

Thus in this embodiment it is possible to make a distinction between ribbon cassettes 60 (more particularly ink ribbons 70) surely by detecting the difference in reflection seal 73 between the ribbon cassettes based on the type of ink ribbon 70.

The detection of the type of each ribbon cassette 60 in this embodiment is performed in a contactless state by the use of both identification mark 71 of the ribbon cassette and photosensor 51 disposed on the carriage 3, so unlike the use of a conventional mechanical switch, the detecting operation requires no moving part and therefore it is possible to ensure a stable operation over a long period. According to this embodiment, moreover, an increase in the number of types of ribbon cassettes 60 can be coped with easily by differentiating the arrangement and pitch of non-reflective portions 72*a* of a reflection seal 73 as the identification mark 71 in each additional type of ribbon cassette from those of the existing reflection seals 73. Thus, the conventional drawback that the structure of the ribbon cassette type detecting sensor is complicated and expensive, leading to an increase of the entire cost of the thermal transfer printer, can be surely eliminated. Besides, all of the case bodies of the ribbon cassettes 60 used in this embodiment are formed in the same shape and same size irrespective of the type of ink ribbon 70, and such ribbon cassettes 60 can be formed efficiently, for example by injection molding of a resin using one type of a mold, whereby not only the labor required for production control, storage and inventory management for the ribbon cassette 60 can be reduced but also it becomes possible to effect mass production of a limited number of types.

According to the thermal transfer printer of this embodiment, moreover, since each ribbon cassette 60 is mounted in a predetermined position of the canopy, the distance from the home position of the carriage 3 to the rightmost end of the identification mark 71 of the ribbon cassette in FIG. 3 is kept constant and hence it is possible to easily detect the moving distance (present position) of the carriage 3 relative to its home position. That is, the moving distance of the carriage 3 relative to the home position can be detected easily by counting the number of steps of the stepping motor which drives the carriage. In other words, the home position can be detected easily. By comparing between the number of steps of the stepping motor corresponding to the distance from the preset home position to the identification mark 71 of each ribbon cassette 60 and the actual number of steps of the stepping motor detected when the carriage 3 is driven, it is made possible to detect a change in the distance between the home position and the ribbon cassette 60. Further, since the position of the identification mark 71 of each ribbon cassette 60 can be detected, it is possible to detect a change in the distance between ribbon cassettes 60 based on temperature. As a result, at the time of ribbon cassette replacement the carriage 3 can be accurately opposed to the ribbon cassette 60. Additionally, it is also possible to correct temperature changes of various portions of the thermal transfer printer caused by changes of the distance.

The following description is now provided about the recording condition.

Figure 5:
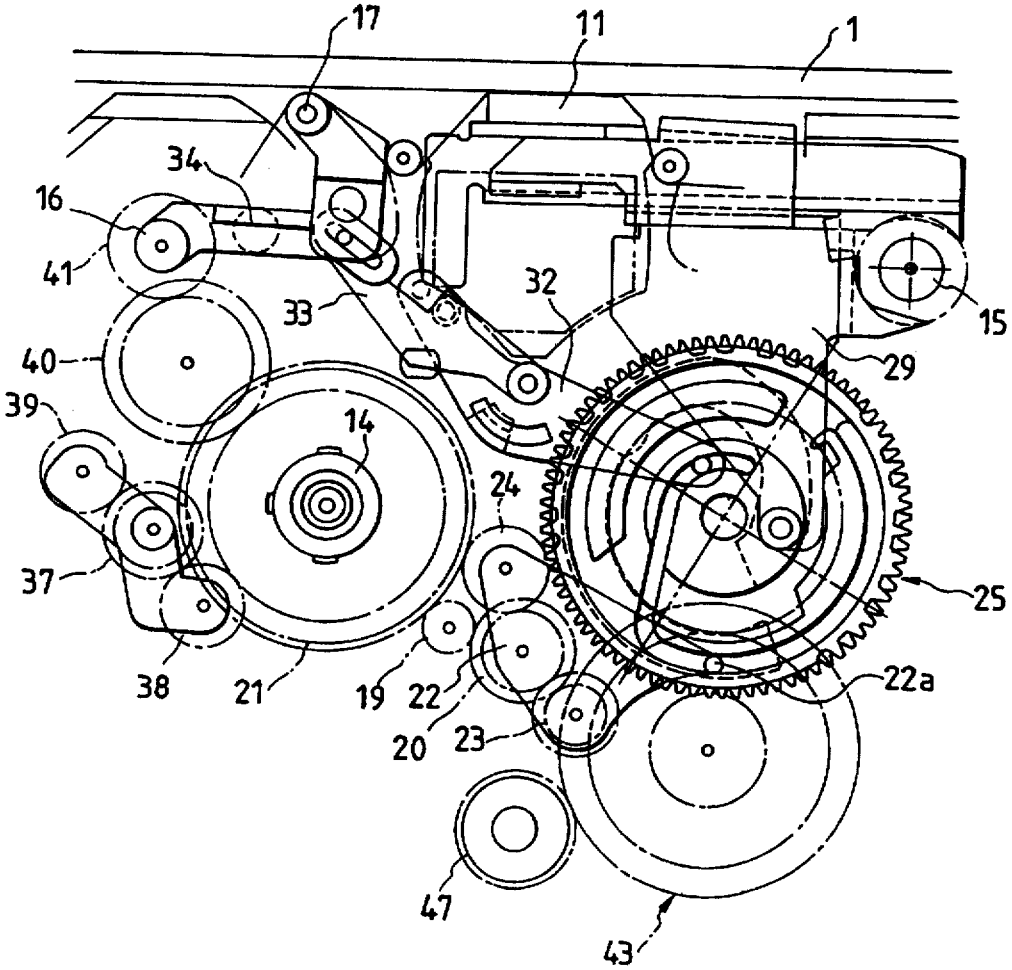
FIG. 5 is a construction diagram of principal portions of the thermal transfer printer, showing a head-down state.

When the stepping motor 18 is rotated clockwise in FIG. 5, the transfer gear 20 rotates counterclockwise, so that the swing plate 22 turns counterclockwise and the first swing gear 23 comes into mesh with the gear 25*a* formed on the outer periphery of the cam 25. In this state, with further rotation of the stepping motor 18 in the same direction, the cam 25 rotates counterclockwise and the pin 29*a* of the head pressing lever 29 comes to be positioned in the innermost peripheral end of the curved groove 28*a* of the head contacting/decontacting cam groove 28 formed in the cam 25. At this time, since the head pressing lever 29 assumes a pivoted state in the leftmost direction, the head mount 11*a* operates together with the lever 29 and the thermal head 11 is held in pressure contact with the platen 1, namely in the head-down state. In this state, the first swing gear 23 is opposed to the toothless part 25*b* of the gear 25*a* formed on the outer periphery of the cam 25, so that the rotating force of the first swing gear 23 is not transmitted to the cam 25 even upon further counterclockwise rotation of the stepping motor 18 and so the cam 25 stops in this position. In this state, since the pin 32*a* of the release roller driving lever 32 is positioned in the innermost peripheral arcuate groove 27*a* of the release roller contacting/decontacting cam groove 27 formed in the surface of the cam 25, the lever 32 assumes a pivoted state in the rightmost direction about the pin 33*c* and the transfer member 33 turns rightward through the pin 33*c*, so that the release roller fixing member 34 assumes a pivoted state toward the platen 1.

During rotation of the cam 25, the rotating force of the stepping motor 18 is transmitted also to the second transfer gear 21, but the gear 35 does not rotate because there is a play between the second transfer gear 21 and the gear 35. In the head-down state the rotating force of the cam 25 is transmitted as a counterclockwise rotating force to the gear 44*b* through the first intermittent gear 25*c*, but the gear 44*c* does not rotate because it is connected through a spring clutch to the gear 44*b* as mentioned previously and hence the delivery gear 42 does not rotate, either, so there is no fear of delivery and loosening of the ink ribbon 70.

In this state, upon further clockwise rotation of the stepping motor 18, the play between the second transfer gear 21 and the gear 35 disappears, so that the rotation of the transfer gear 21 is transmitted to the gear 35, which in turn rotates together with the gear 21. This rotation of the gear 31 is transmitted to the gear 37, which in turn rotates in the clockwise direction. Upon this clockwise rotation of the gear 37, the swing gear 39 meshing with the gear 37 moves pivotally into mesh with the transfer gear 40*a*. Consequently, the rotation of the transfer gear 40*a* is transmitted to the take-up gear 36 and also to the second take-up gear 41 through the transfer gear 40*b*, resulting in rotation of both take-up bobbin 14 and second take-up bobbin 16 to perform the winding operation for the ink ribbon 70.

Thus, in this head-down state, the required recording is carried out by causing the heating elements of the thermal head 11 to generate heat selectively while allowing the carriage to move by operation of the carriage driving motor 4 and by winding the ink ribbon 70 under operation of the stepping motor 18.

The shift from the above head-down state to the head-up state is performed in the following manner.

As the stepping motor 18 is rotated counterclockwise in the head-down state, the first transfer gear 20 rotates clockwise, so that the swing plate 22 pivotally moves rightward, the first swing gear 23 moves away from the outer peripheral portion of the cam 25, and the second swing gear 24 comes into mesh with the gear 25*a* formed on the outer periphery of the cam 25.

In this state, with further rotation of the stepping motor 18 in the same direction, the cam 25 continues to rotate in the clockwise direction and the pin 29*a* of the head pressing lever 29 comes to be positioned in the outermost peripheral, arcuate groove 28*b* of the head contacting/decontacting cam groove 28 formed in the cam 25. At this time, the head pressing lever 29 assumes a pivoted state in the rightmost direction, the head mount 11*a* operates together with the lever 29, and the thermal head 11 is held in the remotest state from the platen 1, that is, held in the head-up state.

In this state, as the stepping motor 18 is rotated clockwise, the first swing gear 23 moves away from the outer peripheral portion of the first swing gear 23 and the second swing gear 24 comes into mesh with the gear 25*a* of the cam 25, causing rotation of the cam.

In this state, as the stepping motor 18 is rotated again in the counterclockwise direction, the pin 22*a* of the swing plate 22 comes to be positioned within the retaining portion 26*e* of the first cam groove 26, causing the second swing gear 24 to move out of engagement with the gear 25*a* formed on the outer periphery of the cam 25. In this position the first gear 23 is also spaced from the outer periphery of the cam 25, so even with further counterclockwise rotation of the stepping motor 18, the rotating force of the motor is not transmitted to the cam 25, which cam is held in a stopped state in this position. In this state, moreover, since the pin 32*a* of the release roller driving lever 32 is positioned in the outermost peripheral, arcuate groove 27*b* of the release roller contacting/decontacting cam groove 27 formed in the surface of the cam 25, the lever 32 assumes a pivoted state in the leftmost direction about the pin 33*c*, so that the transfer member 33 pivotally moves leftward through the pin 32*c* and consequently the release roller fixing member 34 is held in a spaced position from the platen 1. While the cam 25 continues to rotate, the rotating force of the stepping motor 18 is transmitted also to the second transfer gear 21, but the gear 35 does not rotate because there is a play between the gears 21 and 35. During this head-up operation, moreover, since the rotating force of the cam 25 is transmitted as a counterclockwise rotating force to the gear 44*b* through the first intermittent gear 25*c*, the gear 44*c* rotates counterclockwise together with the gear 44*b* as noted previously, whereby the feed gear 42 is rotated clockwise and the winding operation for the ink ribbon 70 is performed.

Even if the carriage 3 is driven in this head-up state, recording will not be performed. For example, however, in the case of making a color recording by using an ink ribbon 70 with plural color inks applied repeatedly in the longitudinal directions it is necessary to feed the ink ribbon 70 without recording until an ink portion of a desired color reaches the position opposed to the thermal head 11, so the stepping motor 18 is further rotated counterclockwise. As a result, when the stepping motor 18 has rotated a predetermined amount, the play between the second transfer gear 21 and the gear 35 disappears, and upon further rotation of the stepping motor 18, the rotation of the transfer gear 21 is transmitted to the gear 35, which in turn rotates together with the gear 21. Then, the rotation of the gear 35 is transmitted to the gear 37, causing the gear 37 to rotate in the counterclockwise direction. As a result, the swing gear 38 meshing with the gear 37 moves pivotally into mesh with the take-up gear 36. Not only the take-up bobbin 14 rotates with rotation of the take-up gear 36, but also the rotation of the gear 36 is transmitted to the second take-up gear 41 through transfer gears 40*a* and 40*b*, thus causing rotation of the second take-up bobbin 16, whereby the winding operation for the ink ribbon 70 is performed.

When in this state the stepping motor 18 is rotated clockwise, the swing plate 22 pivotally moves leftward and the pin 22*a* shifts from the specific position 36*c* to the inside of the first cam groove 26. Upon continued clockwise rotation of the stepping motor 18, the foregoing head-down operation is performed.

Description is now directed to the replacing operation for the ribbon cassette 60 to be loaded onto the cassette carrier 12. Reference will first be made to the operation for loading a desired ribbon cassette 60 onto the cassette carrier 12 which has not been loaded with the cassette yet.

First, the carriage 3 is reciprocated along the platen 1 and the position and type of the ribbon cassette 60 held by a cassette holding portion of the canopy 80. At this time, if the thermal head 11 is in the head-up state, it is brought into the head-down state, while if the thermal head 11 is in the head-down state, the stepping motor 18 is rotated counterclockwise in this state.

As a result, the transfer gear 20 rotates in the clockwise direction, whereby the second swing gear 24 is brought into mesh with the gear 25*a* of the cam 25 and causes the cam to rotate clockwise. As noted in the previous discussion, the thermal head 11 is thereby brought into the head-up state. Upon further rotation of the stepping motor 18 from this head-up state, the pin 29*a* of the head pressing lever 29 moves along the arcuate groove 28*b* formed in the outer peripheral portion of the cam groove 28 while the head-up state is retained.

At this time, the intermittent gear 25*c* formed in the lower portion of the outer periphery of the cam 25 comes into mesh with the gears 44*a* and 44*b* of the transfer member 43 and causes the gears 44*a*, 44*b* to rotate. Consequently, the gear 44*d* rotates, thus causing rotation of the gear 47, with the result that the lift gear 46 rotates. With this rotation of the lift gear 47, the cassette carrier 12 moves upward along the guide members 49*a* and 49*b*. As a result, holding pawls 12*d* and 12*e* of the cassette carrier 12 come into engagement with holding portions 66*a* and 66*b*, respectively, formed in the outer periphery of the ribbon cassette 60 to hold the cassette. At this time, even if there is a slight difference in height between the cassette held positions, vertical wobbling can be absorbed because the lift gear 46 is splined to the shaft 47*a* of the gear 47 through the coiled spring 48 (FIG. 6), and even in the event of collision of the cassette carrier 12 with the ribbon cassette 60, the shock of the collision can be absorbed because the cassette carrier 12 is made vertically movable by the coiled spring 48. Even upon rotation of the gear 44*b*, the transfer gear 44*c* does not rotate since the gears 44*b* and 44*c* are interconnected through a spring clutch.

After the ribbon cassette 60 has been held, the stepping motor 18 is rotated in the clockwise direction, resulting in that the cam 25 rotates in the counterclockwise direction through the first swing gear 23. At this time, the gears 44*a*, 44*d* and 47 rotate through the intermittent gear 25*c* and so does the lift gear 46. Consequently, the cassette carrier 12 goes down onto the carriage 3. In this way the desired ribbon cassette 60 can be loaded onto the carriage 3.

As previously noted, moreover, the engaging members 14*g*, 16*a*, 13*g* and 15*a* for engagement with the engaging portions of the reels 61 and 62 of the ribbon cassette 60, formed on the first and second take-up bobbins 14, 16 and the first and second feed bobbins 13, 15, respectively, are all rendered vertically movable through upwardly urging springs 14*i*, 16*b*, 13*i* and 15*b*. Besides, restriction members (stoppers) 14*j*, 16*c*, 13*j* and 15*c* for restricting the upward movement of the thus spring-biased engaging members 14*g*, 16*a*, 13*g* and 15*a* are formed at the tops of the bobbins 14, 16, 13 and 15, respectively. Therefore, even in the event of unsatisfactory engagement at the time of cassette replacement, the engaging members 14*g*, 16*a*, 13*g* and 15*a* are depressed against the springs 14*i*, 16*b*, 13*i* and 15*b*, and with descent of the cassette carrier 12 the ribbon cassette 60 is loaded onto the cassette carrier. Thereafter, with rotation of the bobbins 13 and 14, there is made alignment between the descended engaging members 14g, 16g, 13g, 15g and the reels 61, 62, and the engaging members on the bobbin side come into engagement with the engaging portions of the reels 61 and 62 and rise, whereby the loading of the ribbon cassette onto the cassette carrier 12 of the carriage 3 is effected positively.

As mentioned previously, the first take-up bobbin 14 and the first feed bobbin 13 are constructed reciprocatably following the movement of the cassette carrier 12 so as to face above the cassette carrier at least partially, so even when the cassette carrier is spaced a maximum distance from the carriage 3, the bobbins 14 and 13 are kept engaged with the ribbon cassette reels and thus there is no fear of loosening of the ink ribbon 70 in the ribbon cassette 60 even under vibrations during movement of the cassette carrier 12. In this state, by rotation of the feed bobbin 13 and take-up bobbin 14, even if the ink ribbon 70 should become loose for some reason or other while it is held by the ribbon cassette holding portion of the ribbon cassette 60, it is possible to eliminate such looseness.

The following description is now provided about the case where the ribbon cassette 60 has already been loaded onto the cassette carrier 12 and it is to be replaced with another ribbon cassette 60.

First, the carriage 3 is reciprocated to detect a ribbon cassette holding portion of the body case in which a ribbon cassette 60 has not been held. Once the position of such ribbon cassette holding portion is detected, the carriage 3 is positioned in the position corresponding to the position and the cassette carrier 12 is moved upward in the manner mentioned above. After a ribbon cassette 60 has been held by the holding portion, the cassette carrier 12 is moved down and the desired ribbon cassette 60 is loaded onto the carrier in the same manner as in the foregoing case where the cassette has not been loaded yet.

Though not illustrated in the drawings, the mechanism for holding the ribbon cassette 60 in a predetermined position of the body case is the same as that of the ribbon cassette holding portion provided on the cassette carrier 12.

The take-up bobbin 62 and feed bobbin 61 for the ink ribbon 70 may be splined onto the fixing shafts of the take-up gear 36 and feed gear 42 so that they move up and down in interlock with the vertical movement of the cassette carrier 12 and so that their rotating forces are obtained in both upper and lower positions, to thereby permit the ink ribbon winding operation to be performed also in the raised position of the cassette carrier.

According to the thermal transfer printer of the present invention, as set forth hereinabove, each ribbon cassette is provided with an identification mark for identifying the type of ink ribbon contained in the ribbon cassette and the identification mark is detected by a sensor disposed on the carriage. By such a simple structure, not only a wide variety of ribbon cassettes can be detected automatically, but also the reduction of cost can be attained.

According to the thermal transfer printer of the present invention, moreover, ink ribbon can be held by bobbins so as not to become loose at the time of ribbon cassette replacement because the bobbins are engaged with ribbon cassette reels; besides, even if the ink ribbon should become loose, the looseness can be removed by driving the bobbins at the time of cassette replacement. Thus, the ribbon cassette replacement can be done in a stable manner.

Further, according to the thermal transfer printer of the present invention, since variations in the height direction of ribbon cassette can be absorbed, it is possible to absorb a shock upon collision of the cassette carrier with the ribbon cassette at the time of cassette replacement and hence the cassette replacement can be done stably.

What is claimed is:

1. A thermal transfer printer comprising:

a platen;

a carriage which carries a thermal head thereon and which reciprocates along said platen;

a cassette carrier disposed on said carriage for loading a ribbon cassette thereon;

a cassette holding portion formed opposedly to said carriage for holding a plurality of ribbon cassettes in predetermined positions;

a sensor disposed on said carriage for detecting, in accordance with movement of said carriage, an ink ribbon identification mark provided on each of said plurality of ribbon cassettes held by said cassette holding portion;

a control section for receiving an output signal provided from said sensor, for determining whether there is any ribbon cassette held by said cassette holding portion, and for determining a type of ink ribbon contained in the ribbon cassettes held by the cassette holding portion in accordance with the received output signal; and a cassette replacement mechanism which loads a desired ribbon cassette selected by said control section onto said cassette carrier automatically by reciprocating the cassette carrier toward and away from said cassette holding portion.

2. A thermal transfer printer according to claim 1, wherein said control section includes means for detecting a moving distance of said carriage from a home position thereof in accordance with an output signal provided from said sensor as the carriage moves.

3. A thermal transfer printer according to claim 1, further comprising a second sensor mounted on the carriage for detecting the presence of a ribbon cassette on said carriage.

4. A thermal transfer printer according to claim 1, wherein said sensor is a photosensor for detecting reflection seals mounted on each of the plurality of ribbon cassettes held by said cassette holding portion.

* * * * *